United States Patent [19]

Soltau

[11] Patent Number: 4,684,290

[45] Date of Patent: Aug. 4, 1987

[54] APPARATUS FOR BELOW-GROUND DRIVING OF PIPELINE SEGMENTS

[76] Inventor: Gerd Soltau, Artlenburger Landstr.15, D-2120, Lüneburg, Fed. Rep. of Germany

[21] Appl, No.: 818,890

[22] Filed: Jan. 15, 1986

[30] Foreign Application Priority Data

Jan. 18, 1985 [DE] Fed. Rep. of Germany ..... 3501536

[51] Int. Cl.[4] ..... F16L 1/02

[52] U.S. Cl. ..... 405/184; 405/154

[58] Field of Search ..... 405/133, 138, 154, 184, 405/303; 173/31, 32, 132; 408/129, 137; 254/29 R

[56] References Cited

U.S. PATENT DOCUMENTS

| | | | |
|---|---|---|---|
| 1,946,214 | 2/1934 | Kabigting | 408/137 X |
| 2,325,565 | 7/1943 | Williams | 405/184 |
| 2,383,496 | 8/1945 | Nebolsine | 405/184 X |
| 3,113,628 | 12/1963 | Orcutt | 405/184 X |
| 3,126,766 | 3/1964 | Bent | 408/137 X |
| 3,512,433 | 5/1970 | Juhasz et al. | 408/137 X |
| 3,955,629 | 5/1976 | Turner | 408/137 X |
| 4,388,021 | 6/1983 | Weiss | 405/184 |
| 4,591,299 | 5/1986 | Eckman | 408/137 X |

FOREIGN PATENT DOCUMENTS

| | | |
|---|---|---|
| 1194656 | 6/1965 | Fed. Rep. of Germany . |
| 1922303 | 8/1965 | Fed. Rep. of Germany . |
| 2448128 | 4/1976 | Fed. Rep. of Germany . |
| 2524969 | 3/1978 | Fed. Rep. of Germany . |

OTHER PUBLICATIONS

Neue Deliwa Zeitschrift, Heft 8/76, Seiten 272–275.

*Primary Examiner*—Cornelius J. Husar
*Assistant Examiner*—Nancy J. Stodola
*Attorney, Agent, or Firm*—Edwin E. Greigg

[57] ABSTRACT

An apparatus for below-ground driving of pipeline segments made from lengths of production pipe, especially those having rated pipeline widths that are not man-sized. Driving is effected by means of a driving apparatus, which is disposed in a jacking shaft and from there drives pipeline segments via a thrust bridge. The driving apparatus comprises threaded driving mechanisms disposed parallel to one another in the length of the pipeline segments. By means of the threaded drive mechanisms, the thrust bridge can be moved back and forth, via at least one motor drive means rotating the parallel threaded spindles of the threaded drive mechanisms about their axes of rotation. The field in which the apparatus is used is preferably sewer construction, involving sewer mains and household connection lines branching off from them. Both types of line can be driven forward out of the jacking shafts, in which the apparatus can be brought into a desired driving direction by rotating it in the shaft.

10 Claims, 3 Drawing Figures

APPARATUS FOR BELOW-GROUND DRIVING OF PIPELINE SEGMENTS

BACKGROUND OF THE INVENTION

The invention relates to an apparatus for below-ground driving of pipeline segments made from lengths of production pipe, using a driving apparatus which is disposed in a jacking shaft and from there drives lengths of pipeline via a thrust bridge.

From German Utility Model DE-GmS No. 82 05 543, an apparatus is known for below-ground driving of production pipes having non-man-accessible rated widths, i.e., widths that are not man-sized. A driving apparatus suitable therefor is described in German Patent Application P No. 34 39 433.8. This driving apparatus comprises a thrust bridge that is displaceably guided on a frame and can be driven forward hydraulically. Perforated strips having specified intervals between holes are provided in the frame. Support bolts that are provided on a hydraulic positioning device can be inserted into the holes of the perforated strips. Driving the thrust bridge forward is accomplished, first, by inserting the support bolts into holes in the frame. Then, pressing bolts of the hydraulic positioning device push the thrust bridge forward by the length of one interval between holes. The pressing bolts are then retracted, and the support bolts are moved out of the holes. The positioning device is now moved forward by the length of one interval between holes, which can be done hydraulically and automatically. Then, the support bolts are inserted into the next holes in the frame, and the pressing bolts again press the thrust bridge gradually forward by the length of one interval between holes. In this manner, the thrust bridge is gradually driven forward in a manner ressemblant of the way in which a crab walks. This driving method, which is presently industry typical, has the disadvantage that the idle time during the resetting of the positioning device represents lost time for the overall driving operation.

OBJECTS AND SUMMARY OF THE INVENTION

It is the principle object of the invention to provide an apparatus for the above general type, in which economies in terms of idle time, and hence lost time, are possible.

This object is attained in accordance with the invention in that the driving apparatus comprises a pair of threaded drive spindles, which are disposed parallel to one another within the length of the pipe segments; by means of these spindles the thrust bridge can be moved back and forth; this is accomplished by having at least one motor drive rotate the parallel threaded spindles of the threaded drive mechanisms about their axes of rotation.

With threaded drive mechanisms of this type, the thrust bridge can be driven forward without idle periods over the entire length of a pipe segment. The driving times are thereby reduced quite substantially, by one-third or even more as compared with the total driving time that was heretofore required.

It is a further object of the invention that the thrust bridge be movable by threaded nuts on the threaded spindles. It is thereby preferably provided that the threaded drive mechanisms comprise planetary roller threaded drive mechanisms, with planetary rollers in the threaded nuts. Threaded nuts such as this, having planetary rollers, are capable of receiving and transmitting extraordinarily large forces. It should be understood that other embodiments of threaded drive mechanisms can also be used.

It is yet a further object of the invention, to provide a thrust bearing, carried by the thrust bridge, which allows for rotation in opposite directions. Because of the rotatable embodiment of the thrust bearing, a drivepipe that is to be driven can be rotated about its own axis.

It is yet another object of the invention that electric and/or oil motors are used for rotating the threaded spindles. By using the rotating drive mechanisms, the engineering needed to accomplish the driving operation can be substantially simplified as compared with hydraulic positioning devices.

BRIEF DESCRIPTION OF THE FIGURES

The invention will be explained in greater detail by reference to the exemplary embodiment shown in the drawing, which comprise: Shown are.

DESCRIPTION OF THE PREFERRED EMBODIMENT

Figure 1:
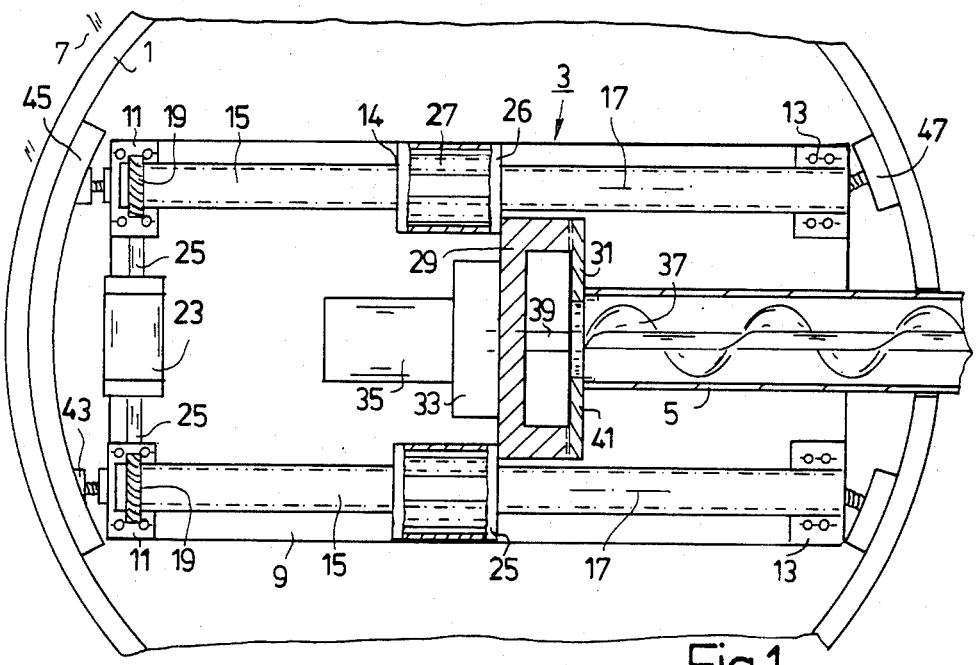
FIG. 1, shows a plan view of an apparatus for below-ground driving of pipelines with the aid of threaded drive mechanisms and a thrust bridge.

In a round jacking shaft approximately 2 m in diameter, there is a driving apparatus 3 for pipelines; as shown in the drawing, the driving apparatus is in the act of driving a drivepipe or length of drivepipe 5 into the earth 7.

Figure 2:
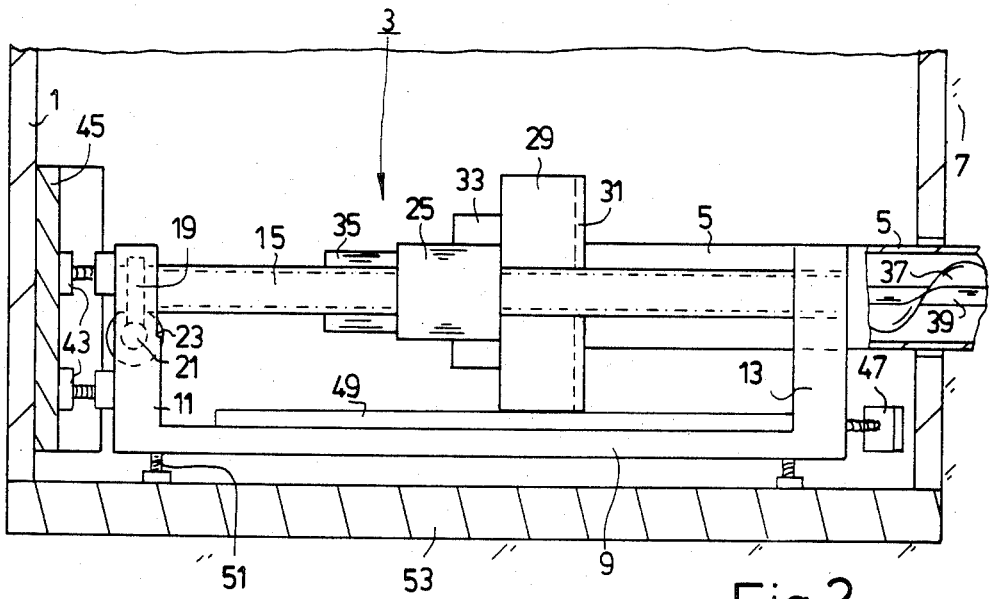
FIG. 2, shows in partial section the apparatus on FIG. 1 in a side view, with a driving shaft shown partially in section.

The driving apparatus 3 is mounted on a frame 9. The frame 9 has bearings 11 and 13 for two threaded spindles 15, which are disposed parallel to one another and belong to threaded drive mechanism 14. The threaded spindles 15 are rotatable about parallel axes 17 in the bearings 11 and 13. To this end, gears 19 are provided on the threaded spindles 15; these gears mesh with threaded worm gears 21 shown in broken lines in FIG. 2. The threaded worm gears 21 are driven via shafts 25 by means of a motor 23. By providing the shared drive means, it is assured in a simple manner that the threaded spindles 15 can rotate at the same speed in the same direction.

Threaded nuts 26 travel on the threaded spindles 15, and planetary rollers 27 are disposed in the threaded nuts 26 so as to positively join them to the threaded spindles 15. In FIG. 1, the threaded nuts and their planetary rollers are shown only schematically, partially cutaway. The threaded nuts 26 together guide a thrust bridge 29, which is provided with an opposed bearing 31 on the side where pressure is exerted on the pipe 5 that is to be driven. Via a gear box 33, the thrust bridge 29 is provided with a motor 35, the shaft of which is capable of causing a conveyor screw 37 to rotate. In another embodiment of the thrust bridge, the opposed bearing 31, instead of the conveyor screw, can also be turned by the shaft 39 that turns the screw; as indicated at 41, the opposed bearing 31 can be rotatably guided on the thrust bridge 29. Via the rotatably guided opposed bearing 31, the drivepipe 5 can then also be turned, instead of the screw 37.

Upon the rotation of the shafts 25 driven by the motor 23, the threaded nuts 26 can be moved to the right or left as the shafts 15 are rotated by the gears 19 via worm gears 25 and the motor 23. If the motor is driven in one rotational direction the threaded nuts 26 are moved along the threaded shafts 15. When the motor is reversed the shafts rotate in the opposite direction and the threaded nuts are then moved in the reverse direction. The threaded nuts 26 do not rotate but move along the shafts 15 as the shafts rotate. As the nuts 26 are moved along the parallel shafts 15, the bridge 29 is moved along with the nuts 26. The motor 35 rotates the screw 37, therefore the screw rotates to form a linear hole in the earth in which the pipe 5 is placed as the screws 26 and bridge 29 move the screw 37 forward. Once the entire length of the pipe has been forced into the hole formed by the screw 37, the pipe is left in the formed hole and the threaded nuts 26, the bridge 29 and screw are moved back toward the motor 23. The process can take place without interruption, so that no idle times occur between the beginning of the driving of a drivepipe 5 and the end of the driving period.

The motors 23 and 35 used in the driving apparatus can be electric motors or hydraulic motors, the speed of which can be controlled by governors.

The driving apparatus 3 is supported in a known manner in the driving shaft 1. This is effected by adjustable supports 43 on the left-hand outer support side that press against a thrust wall 45. Adjustable support legs 47 are provided on the side that is toward the front. For supporting its load, the thrust bridge 29 is guided on rails 49 of the frame 9. The frame 9, in turn, is supported on the shaft bottom 53 via adjustable legs 51.

Figure 3:
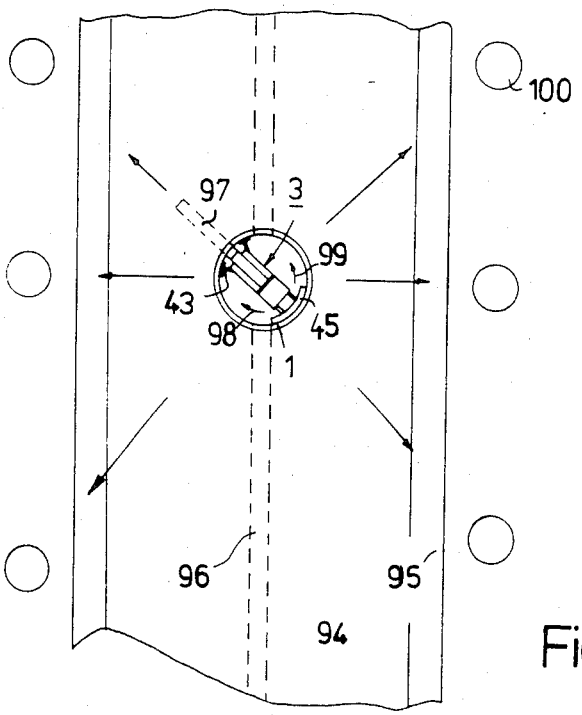
FIG. 3, shows in a top view in an environmental context the preferred use of the apparatus in sewer construction.

The preferred field of application of the apparatus 3 is sewer construction in the vicinity of streets 94 (FIG. 3). The apparatus 3 can be used in circular jacking shafts 1 approximately 2 m in diameter, and inside such a jacking shaft 1 it can be rotated in any desired driving direction (arrows 98, 99). From the jacking shaft 1, the apparatus can be used with short driving elements for below-ground driving of both sewer mains 96 located along the street 94 and household connection lines 97 leading to individual houses, or household connection shafts 100 located beyond the edge 95 of the street. The rated width of the pipes 5 that are to be driven is on the order of magnitude of approximately 250 to 400 mm.

What is claimed is:

1. An apparatus for below-ground driving of pipeline segments made from lengths of production pipe which comprises a driving apparatus and a thrust bridge disposed in a jacking shaft and arranged to drive lengths of pipeline via said thrust bridge, said driving apparatus comprising oppositely disposed threaded drive mechanisms (14) including parallel threaded spindles (15) associated drive means (19) disposed in parallel within the jacking shaft by means of which said threaded drive mechanisms and said thrust bridge are movable back and forth, a motor drive means arranged to rotate said associated drive means and said threaded spindles of said threaded drive mechanisms about their axes of rotation.

2. An apparatus as defined by claim 1, in which said threaded drive mechanism includes threaded nuts and said thrust bridge is movable by said threaded nuts disposed on said parallel threaded spindles.

3. An apparatus an defined by claim 1, in which said threaded drive mechanisms are embodied as planetary roller threaded drive means, and said threaded nut means includes planetary roller means driven by said threaded drive means.

4. An apparatus as defined by claim 2, in which said threaded drive mechanisms are embodied as planetary roller threaded drive means, and said threaded nut means includes planetary roller means driven by said threaded drive means.

5. An apparatus as defined by claim 1, in which said thrust bridge is provided with a second motor drive means, a drive shaft and an opposed bearing, said opposed bearing being adapted to rotate in an opposite direction from that of said shaft.

6. An apparatus as defined by claim 2, in which said thrust bridge is provided with a second motor drive means, a drive shaft and an opposed bearing, said opposed bearing being adapted to rotate in an opposite direction from that of said shaft.

7. An apparatus as defined by claim 3, in which said thrust bridge is provided with a second motor drive means, a drive shaft and an opposed bearing, said opposed bearing being adapted to rotate in an opposite direction from that of said shaft.

8. An apparatus as defined by claim 1, further wherein said apparatus is adapted for use in sewer construction to produce sewer mains and housing connection lines branching off from the sewer mains and to drive pipelines having non-man-sized rated cross sections.

9. An apparatus as defined by claim 1, further wherein said jacking shafts are circular shafts approximately 2 meters in diameter, which upon completion of sewer construction can be converted into manholes.

10. An apparatus as defined by claim 9, further wherein said apparatus is rotatable 360° to assume any desired driving direction, thus allowing driving of sewer mains and household connection lines outward from the jacking shaft.

* * * * *